United States Patent [19]

Lumpp

[11] Patent Number: 4,541,678

[45] Date of Patent: Sep. 17, 1985

[54] PRINTED CIRCUIT BOARD INDEXING AND LOCKING DEVICE

[75] Inventor: Robert E. Lumpp, Addison, Ill.

[73] Assignee: TRW Inc., Redondo Beach, Calif.

[21] Appl. No.: 510,605

[22] Filed: Jul. 1, 1983

[51] Int. Cl.[4] ..... H01R 13/631

[52] U.S. Cl. ..... 339/75 MP; 339/176 MP

[58] Field of Search ..... 339/17 L, 75 MP, 74 R, 339/176 MP

[56] References Cited

U.S. PATENT DOCUMENTS

| | | | |
|---|---|---|---|
| 2,802,188 | 8/1957 | Badders | 339/176 MP |
| 3,553,630 | 1/1971 | Scheingold et al. | 339/74 |
| 3,638,167 | 1/1972 | Occhipinti et al. | 338/74 |
| 3,697,929 | 10/1972 | Konewko et al. | 339/75 |
| 3,920,302 | 11/1975 | Cutchan | 339/176 MP |
| 4,060,300 | 11/1977 | Jayne et al. | 339/74 |
| 4,159,861 | 7/1979 | Anhalt | 339/176 MP |
| 4,165,909 | 8/1979 | Yeager et al. | 339/75 |
| 4,196,955 | 4/1980 | Anhalt | 339/74 |
| 4,221,448 | 9/1980 | Logerot et al. | 339/176 MP |
| 4,223,973 | 9/1980 | Tamburro | 339/186 |
| 4,274,694 | 6/1981 | Leather | 339/74 |
| 4,332,431 | 6/1982 | Bobb et al. | 339/74 |
| 4,403,819 | 9/1983 | Weber | 339/75 MP |

FOREIGN PATENT DOCUMENTS

| | | | |
|---|---|---|---|
| 68195 | 1/1983 | European Pat. Off. | 339/75 MP |

*Primary Examiner*—John McQuade

*Attorney, Agent, or Firm*—Joseph P. Calabrese; John T. Wiedemann

[57] ABSTRACT

A board-indexing arrangement is provided in an end loading, rotary cam actuated, zero-insertion-force circuit board connector. An activating member drives a resilient arm locating member that temporarily presses inward on the edge of a circuit board in the receiving slot of the connector to insure seating of the board against a lateral index surface at the opposite end of the connector and thereby insures registration between the contacts of the connector and the conductors on the board. It also drives the rotary cam of the connector, moving the connector's contact strips in and out of engagement with the circuit board conductors.

10 Claims, 8 Drawing Figures

FIG. 3
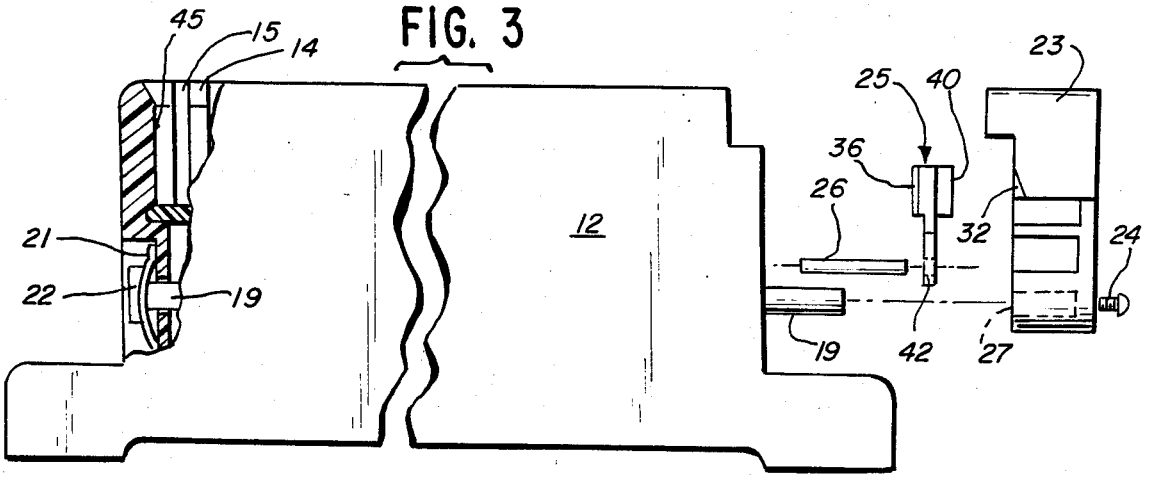
FIG. 4
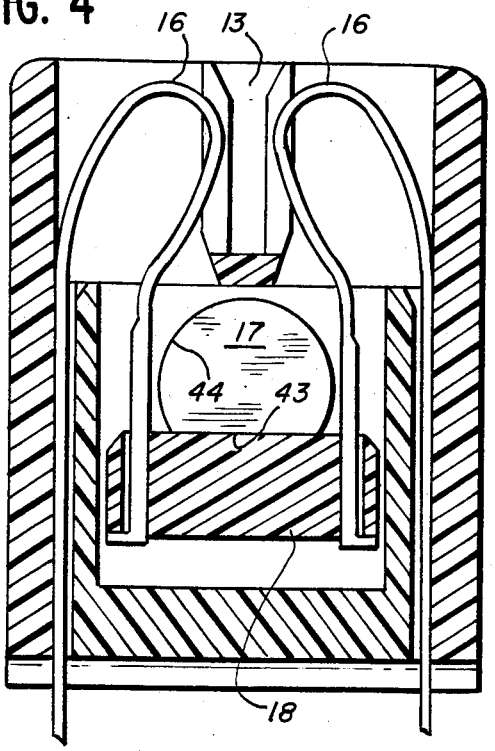
FIG. 5
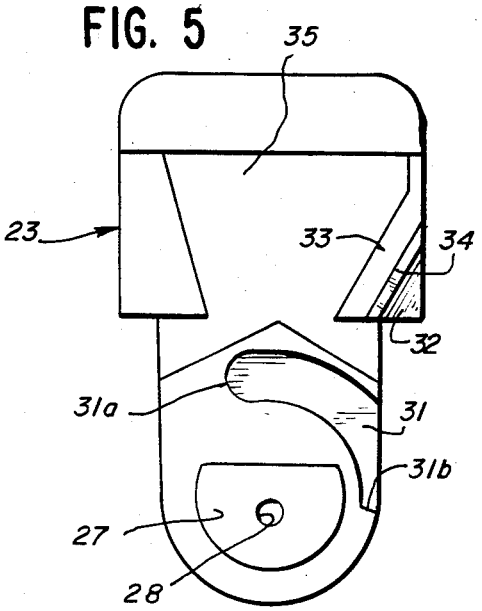
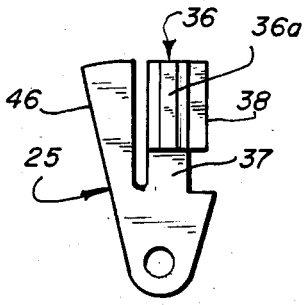
FIG. 8
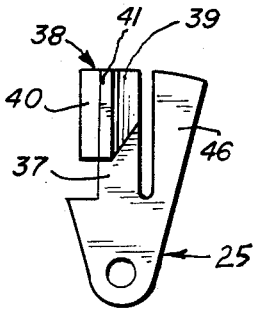
FIG. 7
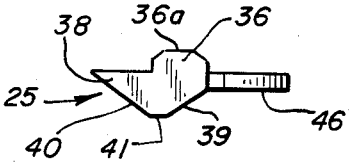
FIG. 6

PRINTED CIRCUIT BOARD INDEXING AND LOCKING DEVICE

BACKGROUND OF THE INVENTION

1. Field of the Invention

The present invention relates to a positioning or centering device in an electrical connector, and more particularly, to a zero-insertion-force electrical circuit board connector with means for assuring registration of the printed boards with the contacts in the connector.

2. Description of the Prior Art

Electrical pathways on printed circuit boards consist of thin coatings of electrically conductive material printed, deposited or formed on one or both sides of the board. The miniature size of the circuits as well as the frailty of the electrically conductive material printed on the board have frequently posed substantial interconnection problems. Generally, to establish a connection between a printed circuit board and a backplane, one may employ a connector of any of a variety of configurations. Such a connector mechanically mounts the board on the backplane while also establishing the requisite electrical interconnections. Making each interconnection consists of forcibly pressing a conductive contact of the connector against a conductor on the circuit board.

Before the interconnection can be made, the circuit board must first be inserted into the connector and the connector's conductive contacts must be aligned with the conductive terminals on the circuit board. In the past, this operation usually was performed by the inherent interfit of the board in the connector or by hand and by eye. However, in laterally loaded connectors, and particularly with reduced dimensions and spacings of the conductors and contacts as well as the frailty of the electrically conductive material printed on the board, greater care and accuracy are desirable.

One solution that has been proposed is to provide guide surfaces in the connector to direct the course of the circuit board to its proper position. But, this requires complicated or exacting connector designs that constrain production.

The locking and indexing device of the present invention provides a mechanism that automatically seats or indexes a printed circuit board in its proper position of registration with the contacts in the connector. In addition, it provides a zero-insertion-force connection by moving the connector contact strips into and out of engagement with the circuit board only in the registration position. It is a simple, reliable device without a multiplicity of parts that insures reliable electrical connections and helps prevent damage to or wear of the interconnection points of the circuit board and the connector.

OBJECTS OF THE INVENTION

It is an object of this invention to provide an indexing and locking arrangement in zero-insertion-force connectors.

It is another object of the present invention to provide a low cost and simplified printed circuit board locking and indexing device for a zero-insertion-force connector that will automatically assure registration of the conductors on a circuit board with the contacts of the connector.

It is another object of this invention to provide a locking and indexing arrangment which will assure an electrical interconnection between a connector and a circuit board, while alleviating circuit board and conductive contact wear or damage and permitting ease of circuit board insertion and withdrawal.

It is a further object of this invention to provide a locking and indexing device for a zero-insertion-force connector that will seat a circuit board in the connector and move the circuit board into and out of registration with the connector contacts.

It is still another object of this invention to provide a locking and indexing arrangement which is simple in design and effective in use.

Other objects, advantages and features of the present invention will become apparent upon reading the following detailed description and appended claims, and upon reference to the accompanying drawings.

SUMMARY OF THE INVENTION

In accordance with one embodiment of this invention, the foregoing objects are achieved by a zero-insertion-force connector locking and indexing device which includes an activating member used in conjunction with a rotary cam and a locating member. The activating member has two driving surfaces that come into contact with two surfaces of the locating member. When one rotates the activating member counterclockwise from a horizontal to a vertical position, the activating member drives the rotary cam, moving the contact strips in the connector into engagement with a circuit board inserted in the connector's circuit board receiving slot and locking the board in place. However, before the contact strips engage the circuit board, the activating member engages the first engaging surface of the locating member and drives the locating member into alignment with the board receiving slot. In this position, the locating member is flexed, and it drives the circuit board in a lateral direction against an index surface at the opposite end of the board receiving slot and into the proper position for mating with the contacts within the connector. Upon further rotation of the activating member, the contacts engage the board, the activating member overrides and disengages the locating member and the locating member moves back out of contact with the board.

To disconnect the circuit board and drive the locating member into position for the next connection, the user rotates the activating member clockwise from a vertical to a horizontal position. Along this path, the activating member's second driving surface engages the second engaging surface of the locating member and drives the locating member out of alignment with the board receiving slot allowing the user to remove the circuit board laterally or vertically.

BRIEF DESCRIPTION OF THE DRAWINGS

For a more complete understanding of this invention reference should now be made to the embodiment illustrated in greater detail in the accompanying drawings and described below by way of an example of the invention. In the drawings:

FIG. 3 is a side elevation view of the zero-insertion-force connector of FIG. 1, partially broken away, and with parts of the locking and indexing mechanism in exploded view;

FIG. 4 is a vertical transverse section through the connector showing the contact strips of the connector in a position of disengagement corresponding to an open position of the locking and indexing mechanism;

FIG. 5 is an enlarged front view of the activating member of the locking and indexing mechanism; and FIGS. 6, 7 and 8 are enlarged top, front and rear views, respectively, of the locating member of the locking and indexing mechanism.

Figures 1, 2:
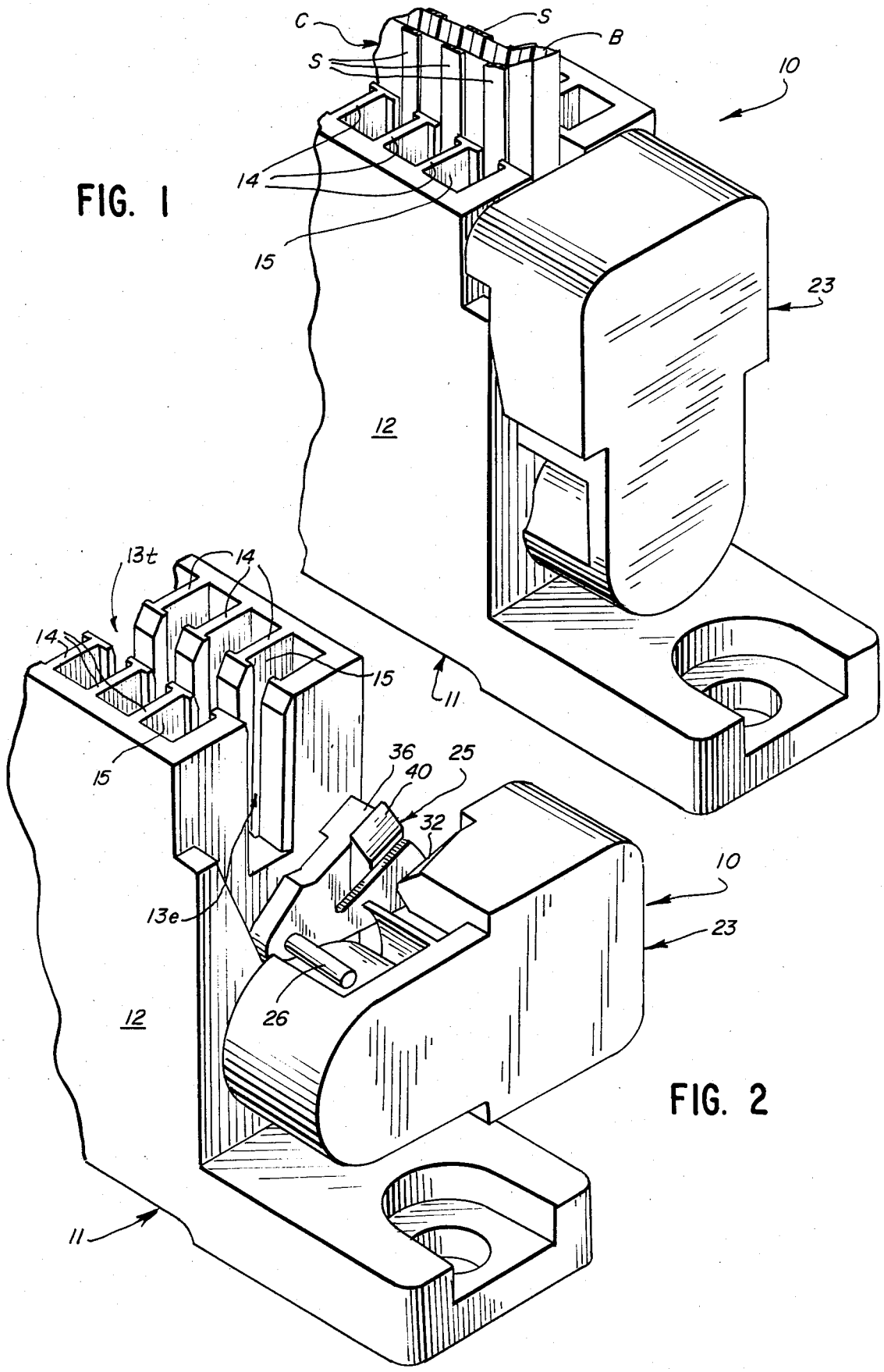
FIG. 1 is a perspective view of a portion of a zero-insertion-force connector employing a preferred embodiment of a locking and indexing mechanism of this invention, showing a circuit board member therein and the mechanism in a closed or locked position.
FIG. 2 is a perspective view of the connector of FIG. 1 with the locking and indexing mechanism shown in the open or unlocked position.

While the invention will be described in connection with a preferred embodiment, it will be understood that it is not limited to this embodiment.

DETAILED DESCRIPTION OF THE DRAWINGS AND A PREFERRED EMBODIMENT

Turning now to the drawings and principally FIGS. 1 and 2, a zero-insertion-force electrical circuit board connector with a locking and indexing mechanism is shown generally at 10. The connector 11 includes an elongated housing body 12 having an elongated slot 13 opening through the top and one end of the housing at 13*t* and 13*e*, respectively, to receive a circuit board member C comprising a relatively rigid body B carrying conductor strips S. A series of ribs 14 along the slot 13 define aperture recesses 15 which house electrical contacts 16 (See FIG. 4). An elongated rotary cam 17 having a generally semi-circular cross-section drives an elongated cam-follower block 18 which then actuates the electrical contacts 16 in and out of engagement with the circuit board (See FIGS. 3 and 4). The manner of operation of the contacts is described more fully in the copending U.S. patent application Ser. No. 510,371 filed July 1, 1983, of Vincent Palecek, which is owned by the assignee of this application. The disclosure of said copending application is incorporated herein by this reference.

Referring now to FIGS. 2 and 3, the cam 17 is an integral part of a shaft 19 which extends along a longitudinal axis of the connector 11 directly beneath the slot 13 and is adapted for rotational movement about this axis. At one end of the connector body 12 is a bow spring 21 engages the cam shaft 19 beneath a shoulder or head 22. The head 22 may be an integral caplike end of the cam shaft 19. An activating or drive member 23 is mounted on the opposite end of shafts 19, adjacent the opposite end of the connector body 12. The spring 21 draws the cam shaft 19 towards the end of the connector where the spring is located. It also draws the activating member 23 against the connector housing 12.

The activating member is suitably attached, as by a screw 24, to the cam surface 19. During the operation of the connector, by rotation of cam 17 and shaft 19, the activating member 23 engages a locating member 25 which is mounted to the connector 11 by a parallel shaft 26. The locating member 25 rotates about this shaft 26 which fits into a bore (not shown) in the connector 11 directly beneath the slot 13 and which acts as a stop for the activating member 23. The axes of shafts 19 and 26 are in the plane of the center of the slot 13.

Referring now also to FIG. 5, the activating member 23 is shown in detail. The activating member 23 is a generally T-shaped handle with a number of recesses and actuating surfaces. It has a contoured counterbore 27 sized to fit the end of cam 17 and cam shaft 19. The activating member 23 is attached to the cam shaft by a screw 24 which passes through an aperture 28 and screws into a threaded hole (not shown) in the cam shaft. An arcuate groove 31 in the activating member 23 has a shape designed to accomodate the distal end of shaft 26 (See FIG. 2) as the activating member 23 moves from a horizontal, open position to a vertical, locking position. The distal ends 31*a* and 31*b* of the arcuate groove 31 acts in conjunction with the shaft 26 to stop the activating member 23 from rotating beyond about a quarter turn path. When the activating member 23 reaches a horizontal position, the shaft 26 abuts against the groove end 31*b* and prevents further clockwise rotation of the activating member. When the activating member 23 reaches a vertical position, the shaft 26 abuts against the groove end 31*a* and prevents further counterclockwise rotation of the activating member. The activating member 23 also has a first inclined driving surface 32 at its leading edge which slopes outwardly and engages the locating member 25 during counterclockwise rotation of the activating member, a second inclined driving surface 33 which slopes inwardly and engages the locating member 25 during clockwise rotation of the activating member, a dividing ridge 34 between surfaces 32 and 33, and a central recess 35. The member 23 may be machined of metal or, preferably molded of plastic.

Turning now to FIGS. 3, 6, 7 and 8, the locating member 25 is a generally flat, plate-like member, preferably molded of plastic material. It includes a radially oriented positioning lug 36 projecting on the rearward or inward side of a resiliently flexible arm 37, and an operating lug 38 on the forward or outward side of that arm. The operating lug 38 has two inclined cam surfaces 39 and 40 divided by a ridge 41. The locating member 25 is mounted on the connector 11 by the shaft 26 which extends through an aperture 42.

To operate the locking and indexing device of the present invention, the user places the activating member 23 in a horizontal or open position, as in FIG. 2. This corresponds to the "open" condition of the connector contacts illustrated in FIG. 4, with the contact strips 16 retracted from the circuit board receiving slot 13 into recesses 15. In this and all other positions, the spring 21 pushes on the head 22 and pulls the cam shaft 19 towards its end of the connector 11. It also pulls the activating member which is attached to the shaft 19 against the respective end of the connector body 12. In this horizontal position, the block 18 abuts against the flat surface 43 of the cam 17 due to the upwardly resilient bias produced by the configuration of the contact strips 16 and by the springiness of the contact strip material (See FIG. 4). Also, in this horizontal position of activating member 23, the shaft 26 abuts against the activating member groove end 31*b*, preventing rotation below the horizontal.

The user then places a circuit board C in the circuit board receiving slot 13 by top loading it or end loading through the exposed end 13*e* which extends through the housing 12 on the side of the connector body 12 with the activating member 23. To position and lock the circuit board in place, the user turns the activating member 23 in a counterclockwise direction. As the activating member 23 rotates, it turns cam 17 in a counterclockwise direction forcing block 18 downward as the circular surface 44 of the cam 17 comes in contact with block 18. The downward movement of the block 18 drives the opposing pairs of the contact strips 16 closer together and into contact with the circuit board.

However, before the contact strips 16 come into contact with the circuit board, the activating member 23 and the locating member 25 push the circuit board transversely to the proper position for the connection. As the user rotates the activating member 23, the inclined driving surface 32 of the activating member 23 comes into contact with the inclined cam surface 39 of the locating member 25, and the activating member 23 rotates the locating member 25 into alignment of the lug 36 with the circuit board receiving slot 13. Due to the inward pressure applied by the activating member 23 on the operating cam lug 38 as a result of the inward spring bias produced by the spring 21, the arm 37 of the locating member is flexed to permit the positioning lug 36 to enter slot 13. Presser surface 36*a* of positioning lug 36 then pushes the circuit board into position against an index or gauging stop surface 45 (See FIG. 3) at the opposite end of the slot 13. This insures seating of the board transversely against that reference surface for centering or indexing purposes to insure registry of the conductors S on the board C with the contacts 16.

Upon further rotation of the activating member 23, the contact strips 16 engage the circuit board conductors S. During this further rotation the inclined driving surface 32 and the ridge 34 of the activating member move past the engaging surface 39 and the ridge 41 of the locating member 25, whereby the activating member 23 overrides and disengages the locating member 25. The arm 37 of the locating member 25 then flexes outward, with the lug 38 entering the recess 35, to partially clear the lug 36 from the slot 13. This flexing back relieves the pressure on the locating member and places it in position for driving back to its cocked or reset position as described below. The member 23 thereupon is in the closed or seated position of FIG. 1 to lock the board in the slot 13 against inadvertent lateral displacement.

The center of rotation of the locating member 25 (shaft 26) is located above the center of rotation of the activating member 23 (shaft 19), i.e. closer to the slot 13. This provides amplification of the angular travel of the driven element 25 relative to the driving element 23, thereby allowing the lateral positioning of the circuit board in the proper location by the element 25 and inward indexing movement against the circuit board member B before the contact strips 16 engage the circuit board.

When the user rotates the activating member 23 back from the vertical to a horizontal position to unlock the connector 11, the activating member turns the cam shaft 19 and cam 17, allowing the block 18 to rise and contact strips 16 to retract into recesses 15 and out of contact with the circuit board. As the member 23 is rotated, the inclined driving surface 33 engages the inclined engaging surface 40 of the locating member 25. The activating member 23 then rotates the locating member 25 clockwise until the stop and guide finger 46 engages a stop such as a shoulder on the body 12 which prevents the locating member 25 from rotating further. The inclined driving surface 33 and the ridge 34 then override and move past the inclined engaging surface 40 and the ridge 41 of the locating member 25 by virture of the resilience of the system. Thus, the activating member 23 again overrides and disengages the locating member 25, and is in the proper relative position for the next actuation. The activating member 23 rotates until the shaft 26 abuts the groove end 31*b* to stop the activating member in its horizontal position.

Thus, a locking and indexing arrangement has been provided in a zero-insertion-force connector which meets the aforestated objects. The indexing is provided by the same operation which effects the electrical contact engagement and disengagement.

While only one embodiment of the invention has been shown, it will be understood, of course, that the invention is not limited thereto since modifications may be made and other embodiments of the principles of this invention will occur to those skilled in the art to which the invention pertains, particularly upon considering the foregoing teachings. For example, although the embodiment shown relates to zero-insertion-force connectors, it will be understood that the invention could be incorporated into a low-insertion-force connector. In addition, the invention could be incorporated into connectors designed for circuit elements other than circuit boards. It is, therefore, contemplated by the appended claims to cover any such modifications and other embodiments as incorporate those features which constitute the essential features of this invention within the true spirit and scope of the following claims.

What is claimed is:

1. A zero-insertion-force connector for indexing and locking a circuit board therein as the connector's contacts engage conductors on the circuit board comprising:

an elongated connector housing having an elongated board receiving slot in one side and opening through one end, and an indexing surface in said slot adjacent the opposite end of said housing;

a plurality of electrical contacts mounted in said housing in parallel spaced relationship along at least one side of said slot;

a first member rotatably mounted in said housing;

a driving member driven by said first member and acting on said contacts to move them between a first position in engagement with a circuit board and a retracted position;

a spring member disposed at the end of said housing opposite said one end, engaging said first member and urging it towards said opposite end;

an activating member fixedly attached to said first member at said one end of said housing and adapted for rotational movement therewith, said activating member having first and second driving surfaces;

a pin mounted in said housing, and extending adjacent said activating member;

a locating member rotatably mounted on said pin, said locating member having first and second engaging surfaces and a presser surface, said first engaging surface disposed to be engaged by said first driving surface of said activating member to position said presser surface in alignment with said slot at said one end of said housing and move said presser surface toward said opposite end of said housing upon rotation of said activating member from a first to a second position, said second engaging surface disposed to be engaged by said second driving surface of said activating member for retraction of said locating member from said slot upon rotation of said activating member from said second to said first position, whereby said presser surface is disposed to engage and press inwardly on a circuit board in said board receiving slot upon rotation of said activating member from said first to said second position to insure seating of said board against said indexing surface and registration of said conductors and said contacts.

2. A connector as in claim 1 wherein said first member has a cross-section which is a segment of a circle.

3. A connector as in claim 1 wherein said activating member is a handle formed from a suitable plastic or metal.

4. A connector as in claim 1 wherein said locating member is molded from a suitable plastic material.

5. A connector as in claim 1 wherein said activating member has a contoured counterbore adapted to fit said first member for connecting said first member with said activating member.

6. A connector as in claim 1 wherein said activating member has an arcuate groove adapted to accomodate said pin, said groove having distal ends that contact said pin to limit rotation of said activating handle.

7. A normally open, zero-insertion force connector comprising a connector housing having a circuit member-receiving slot open at one end, a plurality of electrical contacts mounted on said housing along at least one side of said slot; cam follower means connected to said contacts for moving said contacts into the open and closed positions; locating means rotatably mounted adjacent said housing and having a resilient projecting portion for entering said slot open end and urging a circuit member disposed in such slot against the opposed slot end to assume a desired location relative to said contacts, activator means rotatable about a axis of rotation and having a driving surface portion for engaging with said locating means, and rotatably driving said locating means and deflecting said projecting portion into said slot as said locating means is driven thereover whereby a circuit member is located in said slot relative to said contacts; said activator means also being connected to said cam follower means for closing said contacts after said projecting portion enters said slot; said driving surface portion disengaging from said locating means after said activator means moves over said slot whereby said locating means projecting portion resiliently moves away from said slot.

8. The connector of claim 7 in which said locating means is rotatably mounted on a shaft supported by said housing and said activator means has a groove in which one end of said shaft is received; the ends of said groove defining stops engaging said shaft and which limit the activator means rotatable movement.

9. The connector of claim 7 in which said activator means and said locating means have cooperating surfaces adapted to engage after said activator means driving surface portion has disengaged from said locating means whereby said locating means may be rotated in a second direction of rotation by said activator means back to a starting position without entering said housing slot; said cam follower means being moved to open said contacts during rotation in said second direction.

10. The connector of claim 7 in combination with a cam which interconnects said activator means and said cam follower means, a shaft rotatably mounted in said housing on which said cam and said activator means are mounted, and means in engagement with said shaft for resiliently urging said shaft and activator means against said locating means.

* * * * *